United States Patent [19]

Sullins

[11] 4,054,296

[45] Oct. 18, 1977

[54] SKATEBOARD BRAKE

[75] Inventor: Lloyd Sullins, Lomita, Calif.

[73] Assignee: The Raymond Lee Organization, Inc., a part interest

[21] Appl. No.: 683,015

[22] Filed: May 4, 1976

[51] Int. Cl.[2] ..... A63C 17/14

[52] U.S. Cl. ..... 280/11.2; 188/5

[58] Field of Search ..... 280/11.2, 87.04 A, 11.21, 280/605; 188/5

[56] References Cited

U.S. PATENT DOCUMENTS

| | | | |
|---|---|---|---|
| 1,546,614 | 7/1925 | Binsack | 188/5 X |
| 2,051,762 | 8/1936 | Vincent | 280/87.04 R |
| 2,200,935 | 5/1940 | Rodriguez | 188/5 |
| 3,288,251 | 11/1966 | Sakwa | 280/11.2 X |

*Primary Examiner*—Joseph F. Peters, Jr.
*Assistant Examiner*—Milton L. Smith

[57] ABSTRACT

A skateboard has a guide which allows a vertically elongated plunger to pass through a hole in the board. The guide allows the plunger to move up and down, while preventing rotation thereof. At the lower end of the plunger, below the skateboard, is attached a wooden block. A compression spring pushes the block and plunger upwardly. At the upper end of the plunger is attached a transversely extending cylindrical rod. A pedal is disposed at the upper end of the plunger. The brake is actuated by depressing the pedal.

1 Claim, 2 Drawing Figures

SKATEBOARD BRAKE

SUMMARY OF THE INVENTION

In this invention, a vertically elongated plunger is passed through the skateboard, and is free to move up and down. At the bottom of the plunger is a block. At the top of the plunger is a pedal. A spring urges the plunger, the block and the pedal upwardly. When the skateboard is to be braked, the user steps on the pedal and presses the plunger down against the pressure of the spring. The block is then pressed against the surface upon which the skateboard rolls. In this fashion, the skateboard is braked.

DETAILED DESCRIPTION OF THE PREFERRED EMBODIMENT

Figure 1:
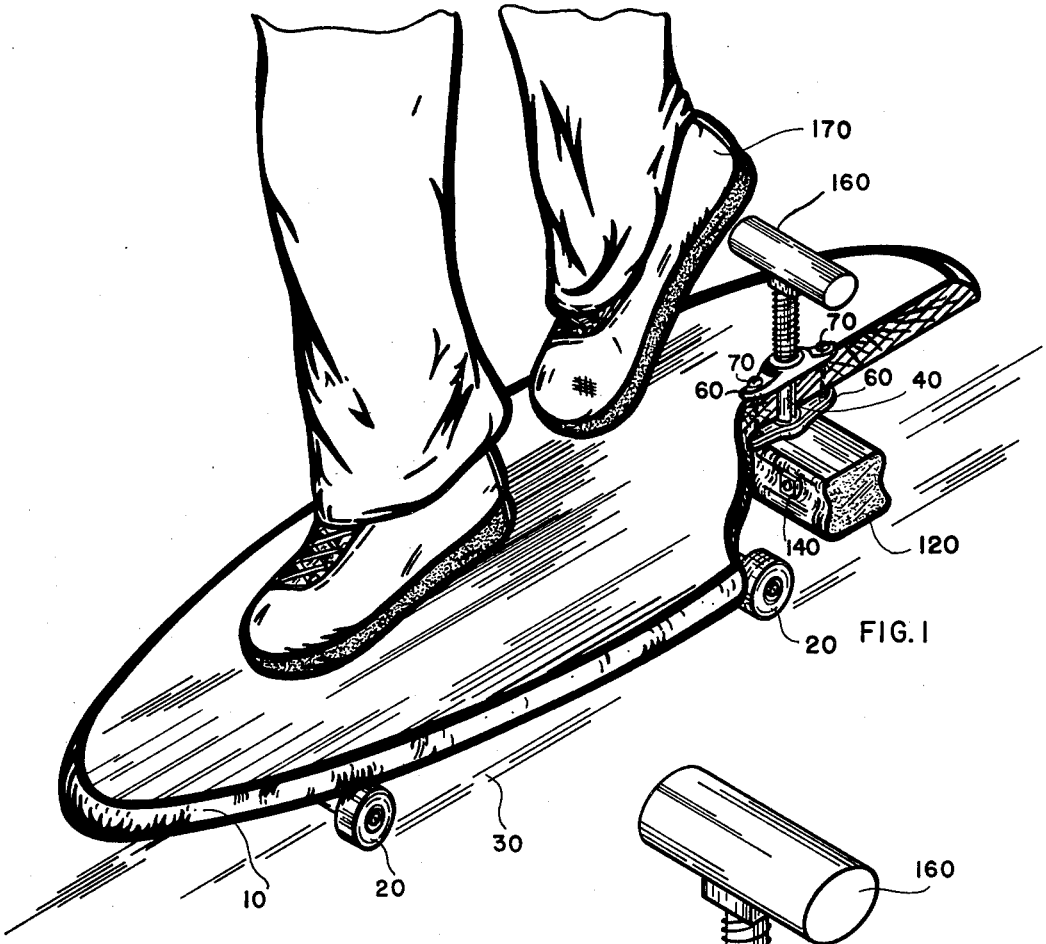
FIG. 1 shows the invention in use.
Figure 2:
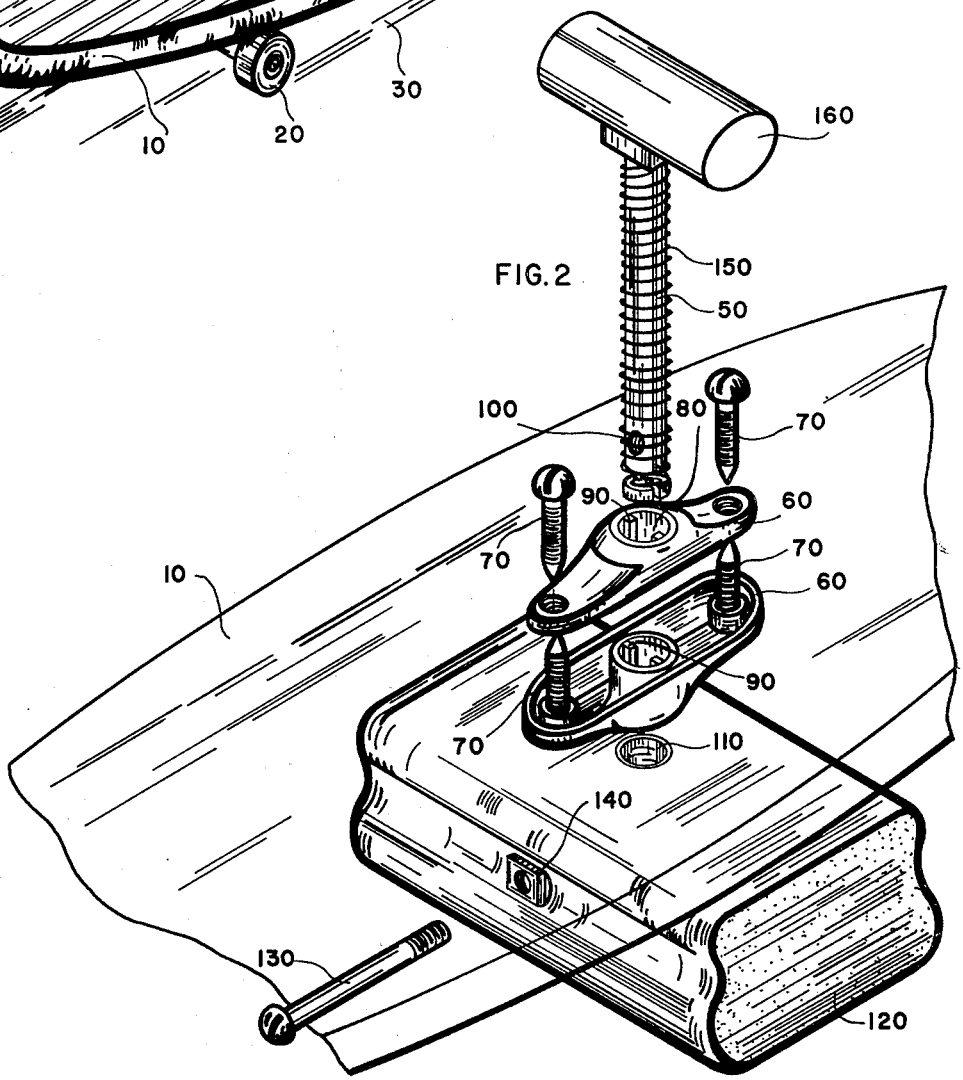
FIG. 2 shows an exploded view of the invention.

A conventional skateboard 10 rolls on rollers 20 along the ground 30. In the rear of the skateboard, a vertical hole is located. Through this hole plunger 40 passes. This plunger is a vertically elongated cylinder with a pair of diametrically opposed grooves 50 cut into its surface.

Two like guide pieces 60 are attached to the board, each being held on the board by two screws 70. Each of the pieces has a hole 80—and the pieces are aligned so that the holes 80 and the hole in the skateboard are vertically aligned. Moreover, each of the pieces has two diametrically opposed tongues 90 extending radially inwardly towards the center of its hole 80. These tongues are also vertically aligned. The tongues engage the grooves in the plunger, with the result that the plunger is free to move up and down, while being prevented from being rotatable in the holes.

The lower end of the plunger has a tapped hole 100. This lower end is inserted into hole 110 in wooden block 120, which is located below the skateboard. An elongated screw 130 passes through bushing 140 in the block, and threads into hole 100, securing the block to the lower end of the plunger.

A compression spring 150 circulates around the plunger, between the skateboard and pedal 160. Pedal 160 is a transversely elongated cylinder located at the top of the plunger. It can be seen that this spring will push the block, plunger and pedal to their upper most positions.

When the user wishes to brake the skateboard, he pushes the pedal with his foot 170. This presses the block against the ground and slows the speed of the skateboard. When the user's foot is lifted off the pedal, the spring lifts the block up so that the braking action is removed.

I claim:

1. A skateboard device comprising:

a horizontally disposed skateboard having front and rear ends and having a vertical bore therein adjacent the rear end, said board having top and bottom surfaces;

front and rear roller means secured to the bottom surface of the skateboard intermediate the bore and the front end;

first and second guide pieces secured to the top and bottom surfaces respectively each guide piece having a hole aligned with said bore, each hole having two diametrically opposed tongues therein which are spaced from each other, the tongues in one piece being aligned with the tongues in the other piece;

a vertical cylindrical plunger extending slidably through the bore, said plunger having oppositely disposed vertical grooves in its outer surface engaged by said tongues whereby the plunger is vertically slidable in the bore but cannot rotate therein, said plunger having an upper end extending above the guide piece on the top surface of the board and a lower end extending below the guide piece on the lower surface of the board;

a horizontal pedal secured to the upper end of the plunger;

a horizontally elongated block secured to the lower end of the plunger; and a coil spring disposed around the plunger between the handle and the guide piece on the top surface of the board to normally bias the plunger into fully raised position.

* * * * *